US010166646B2

(12) United States Patent
Mandler

(10) Patent No.: US 10,166,646 B2
(45) Date of Patent: Jan. 1, 2019

(54) POLISHING DEVICE FOR POLISHING CONCAVE LENS FACES OF OPTICAL LENSES, AND METHOD FOR OPERATION THEREOF

(71) Applicant: OptoTech Optikmaschinen GmbH, Wettenberg (DE)

(72) Inventor: Roland Mandler, Heuchelheim (DE)

(73) Assignee: OptoTech Optikmaschinen GmbH, Wettenberg (DE)

( * ) Notice: Subject to any disclaimer, the term of this patent is extended or adjusted under 35 U.S.C. 154(b) by 163 days.

(21) Appl. No.: 15/171,197

(22) Filed: Jun. 2, 2016

(65) Prior Publication Data

US 2016/0361790 A1 Dec. 15, 2016

(30) Foreign Application Priority Data

Jun. 15, 2015 (DE) ..... 10 2015 109 495
Sep. 8, 2015 (DE) ..... 10 2015 115 078

(51) Int. Cl.
*B24B 13/02* (2006.01)
*B24B 13/00* (2006.01)

(52) U.S. Cl.
CPC ..... *B24B 13/02* (2013.01); *B24B 13/0037* (2013.01); *B24B 13/023* (2013.01)

(58) Field of Classification Search
CPC .... B24B 13/0037; B24B 13/02; B24B 13/023
See application file for complete search history.

(56) References Cited

U.S. PATENT DOCUMENTS 3,877,177 A * 4/1975 Taniguchi ..... B24B 13/00 451/159
6,012,965 A * 1/2000 Savoie ..... B24B 13/0055 451/384

(Continued)

FOREIGN PATENT DOCUMENTS

DE 10 2007 026 841 12/2008
DE 10 2009 006797 8/2009

(Continued)

OTHER PUBLICATIONS

DE 102009006797 A1 Aug. 2009 English Machine Translation.*

*Primary Examiner* — Marc Carlson
(74) *Attorney, Agent, or Firm* — Clark & Brody

(57) ABSTRACT

A polishing device for polishing curved lens faces of optical lenses has a workpiece holder for receiving an optical lens and a polishing tool. The polishing tool has a support element, an elastic substructure and a curved polishing surface on the elastic substructure. The polishing tool, with the polishing surface, is driven in a rotating manner about a rotation axis, the workpiece holder being driven in a rotating manner about a first axis, in order to rotate the optical lens. A distance between the workpiece holder and the polishing tool is adjustable along a second axis. An offset between the workpiece holder and the polishing device is adjustable along a third axis, which is aligned transversely in relation to the first axis. A pitch angle between the rotation axis and the first axis is adjustable by tilting about a fourth axis. A method of operating the device is also disclosed.

14 Claims, 4 Drawing Sheets

(56) References Cited

U.S. PATENT DOCUMENTS

Figure 1:
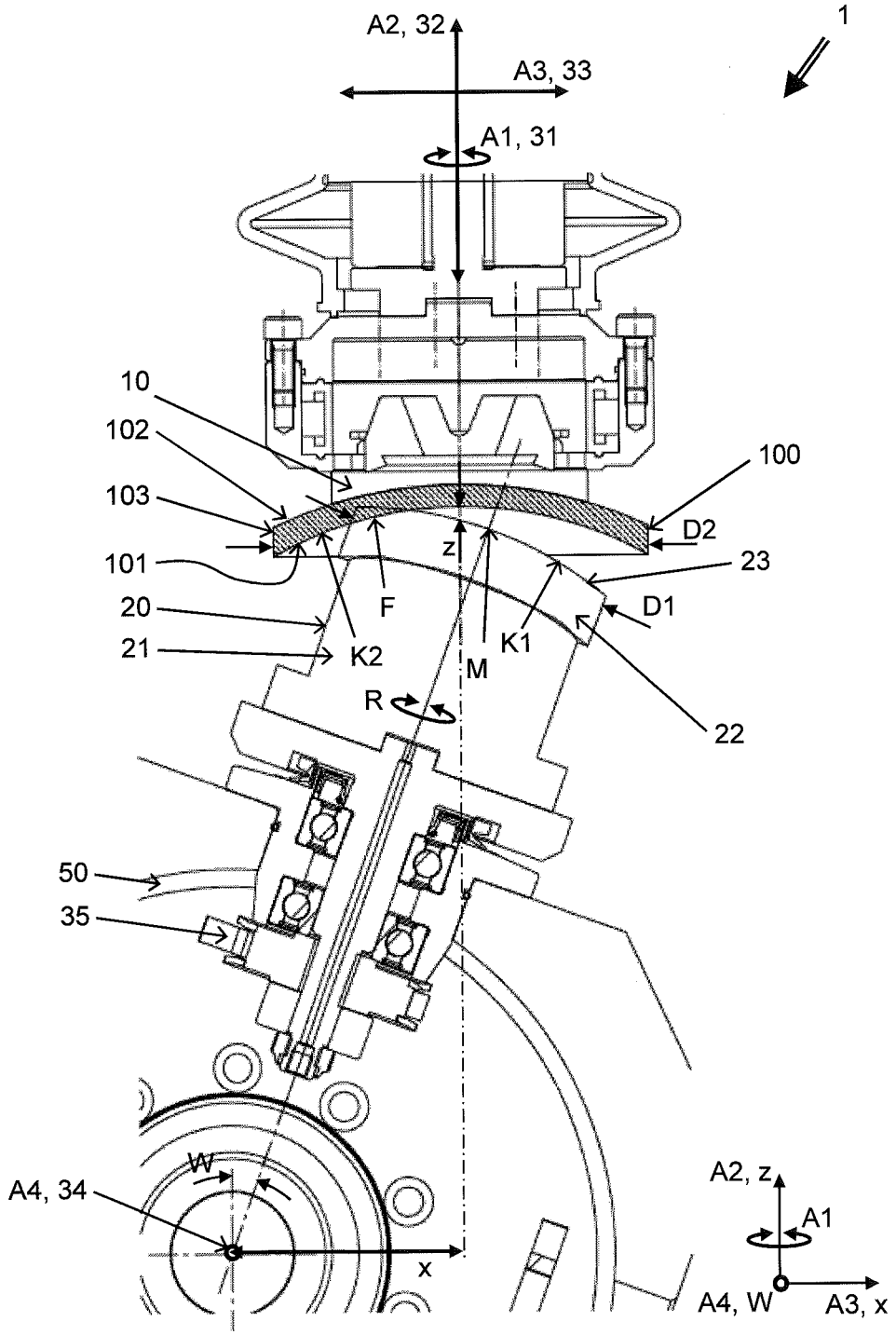

| | | | | |
|---|---|---|---|---|
| 6,722,962 | B1 * | 4/2004 | Sato | B24B 37/04 451/259 |
| 2007/0293128 | A1 * | 12/2007 | Schafer | B24B 13/0037 451/7 |
| 2011/0275295 | A1 * | 11/2011 | Nowak | B24B 13/00 451/540 |
| 2013/0303059 | A1 * | 11/2013 | Sangster | B24B 13/01 451/177 |

FOREIGN PATENT DOCUMENTS

| | | | | |
|---|---|---|---|---|
| DE | 102009006797 | A1 * | 8/2009 | B24B 13/00 |
| DE | 10 2014 003598 | | 9/2015 | |
| EP | 1 655 102 | | 5/2006 | |
| EP | 1 867 430 | | 12/2007 | |
| EP | 2 384 854 | | 11/2011 | |
| EP | 2 662 185 | | 11/2013 | |

* cited by examiner

POLISHING DEVICE FOR POLISHING CONCAVE LENS FACES OF OPTICAL LENSES, AND METHOD FOR OPERATION THEREOF

The invention relates to a polishing device for polishing curved lens faces of optical lenses, according to the preamble of claim 1, and to a method for operation thereof, according to claim 8.

In order to achieve an optically effective lens surface, optical lenses are polished by means of polishing devices. Polishing devices having a workpiece holder, which receive an optical lens and rotate about a rotation axis, are thus known from the prior art. A polishing tool, having a polishing surface, is placed on the free lens surface, which may be concave, convex, toric, spherical or of a free-form shape.

For the purpose of machining concave lens faces, it is known from DE 10 2007 026 841 A1 to use a polishing tool, which has a support disk, mounted on which there is an elastic substructure. The polishing surface is disposed on the elastic substructure. Thus, rotating the support disk also causes the polishing surface to rotate about a rotation axis perpendicular to the support disk. In this case, the rotation axes of the optical lens and of a drive shaft of the polishing tool are aligned parallelwise. The support disk, in turn, is connected to the drive shaft via a cardanic compensating joint.

For the purpose of setting the removal profile during polishing, the polishing machines used in the prior art thus have three axes driven in an interpolating manner, namely a) the speed about the rotation axis of the workpiece holder,
b) a position along a first displacement axis for a lateral displacement between the rotation axes of the workpiece holder and of the polishing tool,
c) and a position along a second displacement axis for setting the distance between the workpiece holder and the polishing tool.

The cardanic compensating joint constitutes a degree of freedom, such that the polishing tool is placed in a statically indeterminate manner on the lens surface and always lies flatly on the lens surface, for which purpose it oscillates about the compensating joint. The surface curvature of the polishing surface usually corresponds substantially to the surface curvature of the concave lens face.

It is a disadvantage of such a design that the polishing tool can be moved only to a very limited extent beyond a circumferential edge of the lens face. The result of this is that the contact pressure in the direction of the center of the lens decreases greatly even in the case of a small protrusion. If an even greater portion of the polishing surface is moved beyond the circumferential edge, the polishing tool tilts over.

A further disadvantage of such polishing tools is that the contact pressure force over the polishing surface results in the polishing removal of the lens surface tending in the direction of a sphere. As a result, optical geometries already produced on the lens surface become polished-out. To enable narrow radii to be polished at all on the lens surface, large contact pressures are required in order to reach them, as a result of elastic deformation of the support disk and/or the elastic substructure. As a result of this, the polishing tendency toward a sphere is amplified further in these lens regions.

It is therefore the object of the invention to develop a polishing device and a polishing method, which can be used to machine lens surfaces that have superimpositions of spherical, toric and progressive effects and that thus constitute free-form faces, which are described by pure point clouds, without these effects being polished-out during polishing. The device and the method are additionally intended to enable polishing work to be performed on such lens faces in a rapid, efficient and inexpensive manner.

The invention relates to a polishing device for polishing curved lens faces of optical lenses, the polishing device having a workpiece holder for receiving an optical lens and having a polishing tool, the polishing tool having a support element, an elastic substructure and a curved polishing surface on the elastic substructure, the polishing tool, with the polishing surface, being driven in a rotating manner about a rotation axis, either the curved lens face being concave and the curved polishing surface being convex, or the curved lens face being convex and the curved polishing surface being concave, the workpiece holder being driven in a rotating manner about a first axis, in order to rotate the optical lens, a distance between the workpiece holder and the polishing tool being adjustable along a second axis, an offset between the workpiece holder and the polishing device being adjustable along a third axis, which is aligned transversely in relation to the first axis, and a pitch angle between the rotation axis and the first axis being adjustable by tilting, in particular actively, about a fourth axis.

The polishing device has the advantage that a polishing performance is achieved that is up to ten times greater than is achieved with a cardanically mounted polishing disk. Moreover, the tilting enables a constant removal profile to be achieved in narrower and wider radii. In addition, even the region adjoining the circumferential edge can be machined in a very satisfactory and precise manner. As a result of this, geometries on the optical surface are not polished-out. This is because of the absence of the phenomenon whereby the polishing tool tends to machine the lens face in the direction of a sphere. Rather, by means of the elastic substructure of the polishing tool and the pitch angle, it is possible to compensate deviations, caused by a progressive component of the lens surface from a relative face of the polishing surface in the form of a spherical segment to a purely spherical, partial contact area. Moreover, cylinder effects of up to ten cylinders can be produced by means of such a polishing device. It succeeds as a whole, in a first variant, for machining concave lens faces by means of a convex polishing surface, and in a second variant for machining convex lens faces by means of a concave polishing surface. By changing the set-up, in particular in an automated manner, it is additionally possible to use the device to polish a concave front lens face and the opposite, convex lens face on the back side. Thus, in particular, very complex spectacle lenses can be produced.

The curved lens face is located on the front side of the lens or on the back side of the lens. The curved lens face does not include a circumferential edge of the lens. The curved lens face may optionally be a partial face of the front side of the lens or of the back side of the lens. Preferably, optical lenses are polished with a circular circumferential edge. The circumferential edge delimits the front side of the lens and the back side of the lens, at their circumference in each case.

The first axis in this case should be aligned perpendicularly through the center of the curved lens face. Accordingly, the first axis will be substantially or exactly perpendicular to a receiver of the workpiece holder in which an optical lens is received.

It is additionally achieved according to the invention that the polishing surface rotates in a defined rotationally symmetrical area about the rotation axis. This is not the case with a cardanically oscillating mounting as in the prior art. The rotationally symmetrical area may be, in particular, a sphere, at least outside of an area of contact with the lens face, where an elastic deformation of the polishing surface occurs.

The polishing surface in this case should rotate about its center. Although the polishing surface can project as far as its center, in many applications it is nevertheless also possible to use polishing tools in which an annular polishing surface or a polishing surface in the shape of a ring segment is disposed around the center.

A comparatively simple interpolating motion kinematics of the first, second, third and fourth axis is achieved if the first axis is parallel to the second axis.

According to a more detailed embodiment of the polishing device, when there is an optical lens received in the workpiece holder, the polishing tool can be placed, according to the pitch angle, obliquely on the curved lens face, and a strip-type contact area can be realized between the polishing surface and the curved lens face as a result of deformation of the elastic substructure.

The pitch angle between the rotation axis and the first axis should be of such a magnitude that the polishing surface is partially raised from the curved lens face, as it were, floating over the latter. In this case, a portion of the polishing surface then floats above the lens face at a lateral distance from the contact area. The more strongly the polishing tool is pressed against the lens surface, the greater the pressing force becomes, and the contact area becomes wider. Both correlate with the removal rate. By setting the pitch angle it is possible, in particular, to regulate to a constant removal profile over the length of the contact area. In particular, a suitable contact angle is one at which the polishing tool has no contact with the lens face in the region of the rotation axis. This results in the velocity vector profile becoming more constant in the contact area.

Also instrumental in this is a special embodiment, according to which the strip-type contact area extends at both ends as far as a circumferential edge of the curved lens face. This enables the contact pressure to be regulated to a homogeneous value over the length and as far as the ends of the strip-type contact area. For this purpose, either the surface curvature of the convex polishing surface should be less than the surface curvature of the concave lens face, or the surface curvature of the concave polishing surface should be greater, or more pronounced, than the surface curvature of the convex lens face. Moreover, the diameter of the polishing surface is to be selected such that it is greater than the diameter of the lens face to be polished, preferably at least 20% greater.

Furthermore, in a more detailed embodiment of the polishing device, it is provided that the latter has an electric controller by which, during a polishing process, in particular exclusively, the speed of rotation of the workpiece holder about the first axis, the distance between the workpiece holder and the polishing tool along the second axis, the offset between the workpiece holder and the polishing tool along the third axis, and the pitch angle between the rotation axis and the first axis, by tilting about the fourth axis, are driven in an interpolating manner.

The interpolation enables the contact pressure of the contact area to be regulated to a constant value over its length. In addition, the contact pressure can be regulated to a desired value, which, for example, is greater at the start of the polishing operation than at the end of the polishing operation. This produces a finer polish grinding as polishing progresses. A CNC controller is a possibility as an electric controller.

According to a special variant of the polishing device, the rotating drive of the workpiece holder about the first axis is effected by means of a first drive, the adjustment of the distance between the workpiece holder and the polishing tool along the second axis is effected by means of a second drive, the adjustment of the offset between the workpiece holder and the polishing tool along the third axis is effected by means of a third drive, and the adjustment of the pitch angle between the rotation axis and the first axis is effected by means of a fourth drive. The interpolating combined action can thereby be performed as freely as possible, since the drives can be controlled independently.

It should be mentioned in connection with this that the rotation of the polishing tool, with the polishing surface, about the rotation axis may expediently be effected by a spindle drive.

In such an embodiment, the polishing device may have an electric controller by which, during a polishing process, in particular exclusively, the rotational speed of the first drive, the position of the second drive, the position of the third drive, and the position of the fourth drive are driven in an interpolating manner. Rotating motors are therefore suitable for the first drive and, in particular, positioning motors for the second, third and fourth drive.

In a particular configuration of the electric controller, the pitch angle is regulated, by means of the control means, to a value at which a maximally uniform contact pressure force is present over the length of a strip-type contact area between the polishing surface and the curved lens face.

According to a particular embodiment of the polishing device, the second axis and the third axis are mechanically coupled to the workpiece holder. This means that the workpiece holder moves absolutely along the second axis and the third axis. The optical lens therefore moves in two directions in space, and in so doing rotates about the first axis.

In the case of an optional embodiment of the polishing device, the fourth axis is mechanically coupled to the polishing tool. Accordingly, the polishing tool is tilted about the fourth axis. At the same time, it can rotate about the rotation axis. A simple interpolating kinematics is achieved if the rotation axis intersects the fourth axis, preferably perpendicularly. Preferably, in addition, a design is selected in which the polishing tool is rigidly coupled to a drive axis. Neither changes in angle nor changes in length should be possible, so that a CNC-controlled defined position without degrees of freedom can be approached with the polishing tool. In particular, the polishing tool should not have a cardanic compensating joint, or be mounted on such a joint.

Preferably, the workpiece holder is disposed geodetically above the polishing tool. Removed stock and excess polishing agent thus do not get on to the lens face to be polished, but drop down.

The device is particularly suitable for machining curved lens faces that have a basic toric shape and that may also include progressive action areas.

The invention additionally relates to the use of a polishing device, described above, for polishing a curved lens face of an optical lens, in particular concave or convex lens faces. The advantages described above are likewise achieved by the use, according to the design of the polishing device.

The invention additionally relates to a method for operating a polishing device, described above, in which the following steps are performed:

a) receiving an optical lens by means of the workpiece holder, in particular before the following steps are performed, b) placing the polishing tool, with the polishing surface, on the curved lens face, c) rotating the polishing tool about the rotation axis, and d) performing a polishing operation by driving in an interpolating manner, or modulating in an interpolating manner the speed of rotation of the workpiece holder about the first axis, the distance between the workpiece holder and the polishing tool along the second axis, the offset between the workpiece holder and the polishing tool along the third axis, and the pitch angle between the rotation axis and the first axis, by tilting about the fourth axis.

An advantage of this is that a polishing performance is achieved that is up to ten times greater than is achieved with a cardanically mounted polishing disk. Moreover, the modulated tilting enables a constant removal profile to be achieved in narrower and wider radii. In this case, even the region adjoining the circumferential edge can be machined in a very satisfactory and precise manner. As a result of this, geometries on the optical surface are not polished-out. Cylinder effects of up to ten cylinders can be produced according to the method. In the polishing operation, it suffices for four axes to interpolate with one another, namely, the first, second, third and fourth axis. For the purpose of performing the polishing operation, a polishing agent that can be contained in the polishing surface or in a supplied fluid should be provided.

What is achievable, in particular, with the method is that, upon each rotation of the lens blank about the first axis, an interpolating motion of the second, third and fourth axis is effected. In order to improve the quality of grinding in this case, the rotational speed about the first axis is preferably modulated at the same time. A good grinding pattern is achieved, in particular, if the interpolating motion of the second, third and fourth axis is continuous.

In a special design of the method, the driving in an interpolating manner takes into account, as a first objective function, a pitch angle at which a maximally uniform contact pressure force is present over the length of a strip-type contact area between the polishing surface and the curved lens face. A uniform removal profile is thereby achieved over the length of the contact area. For this purpose, the shape and position of the polishing tool, and the shape and position of the optical lens, or of its lens face, should be known, as input variables.

A further, optional, method design provides that the driving in an interpolating manner takes into account, as a second objective function, a strip-type contact area between the polishing surface and the curved lens face that extends at both ends as far as a circumferential edge of the curved lens face. The effect of this is that there can be a constant contact pressure force present, extending to the end region of the strip-type contact area, within the lens face.

According to a further embodiment of the method, the driving in an interpolating manner takes into account, as a third objective function, a contact pressure force that is maximally uniform over a revolution of the optical lens. A uniform contact pressure force is thus achieved, not only from a stationary viewpoint, over the length of the contact area, but also during a progressive movement of the contact area over the lens face. A constant removal profile is thereby achieved over the entire lens face.

Furthermore, an additional design of the method provides that the driving in an interpolating manner takes into account, as a fourth objective function, a constant removal profile in the contact area between the polishing surface and the curved lens face. In this case, besides the contact pressures in the contact area, the relative speeds between the polishing surface and the lens face are also taken into account. Removal rates that are homogeneously distributed over the contact area are obtained as a result.

Also instrumental in achieving a desired polishing behavior is a method variant according to which, for each revolution of the lens blank about the first axis, the pitch angle between the rotation axis and the first axis is tilted to and fro, or tilted forward and backward, twice, in particular exactly, twice, about the fourth axis. This, in particular, when a lens face having a basic toric shape is being polished. In this way, the pitch angle can be adapted to the basic toric shape, and a uniform contact pressure force is achieved in each rotation angle over the length of the contact area.

Also instrumental is a method design according to which, for each revolution of the lens blank about the first axis, the offset between the workpiece holder and the polishing tool along the third axis oscillates to and fro twice, in particular exactly twice, in particular oscillates to and fro about a zero position. This again, in particular, when a lens face having a basic toric shape is being polished.

Additionally instrumental in achieving a harmonious grinding pattern is a variant in which the adjustment of the offset between the workpiece holder and the polishing tool along the third axis is overlaid with an oscillatory motion along the third axis, the oscillatory motion being less than the adjustment of the offset. As a result, larger circular grinding paths about the center of the lens face are overlaid with smaller circular grinding paths. A particularly fine grinding pattern is obtained, in which the larger grinding paths are not discernible as a result of light diffraction, but are obliterated.

According to a preferred execution of the method, the rotating of the polishing tool about the rotation axis is effected at a constant rotational speed, between starting-up and decelerating. Consequently, the rotational speed thus does not interpolate with the first, second, third and fourth axis. It is particularly suitable for polishing if the polishing tool rotates about the rotation axis at a rotational speed of between 600 and 1500 revolutions per minute, between starting-up and decelerating. The method should be executed such that the rotational speed of the rotation of the polishing tool about the rotation axis, between starting-up and decelerating, is greater than the maximum rotational speed of the rotation of the workpiece holder about the first axis. The rotational speed of the rotation of the workpiece holder about the first axis during the polishing operation may expediently be modulated to values of between 0 and 100 revolutions per minute. A high removal rate is thus achieved with the rapidly rotating polishing surface, while the distribution of the removal rate over the lens face is effected by the interpolation on the part of the less rapidly acting first, second, third and fourth axis. The polishing operation can be effected in a correspondingly rapid and efficient manner for each optical lens.

Figure 2:
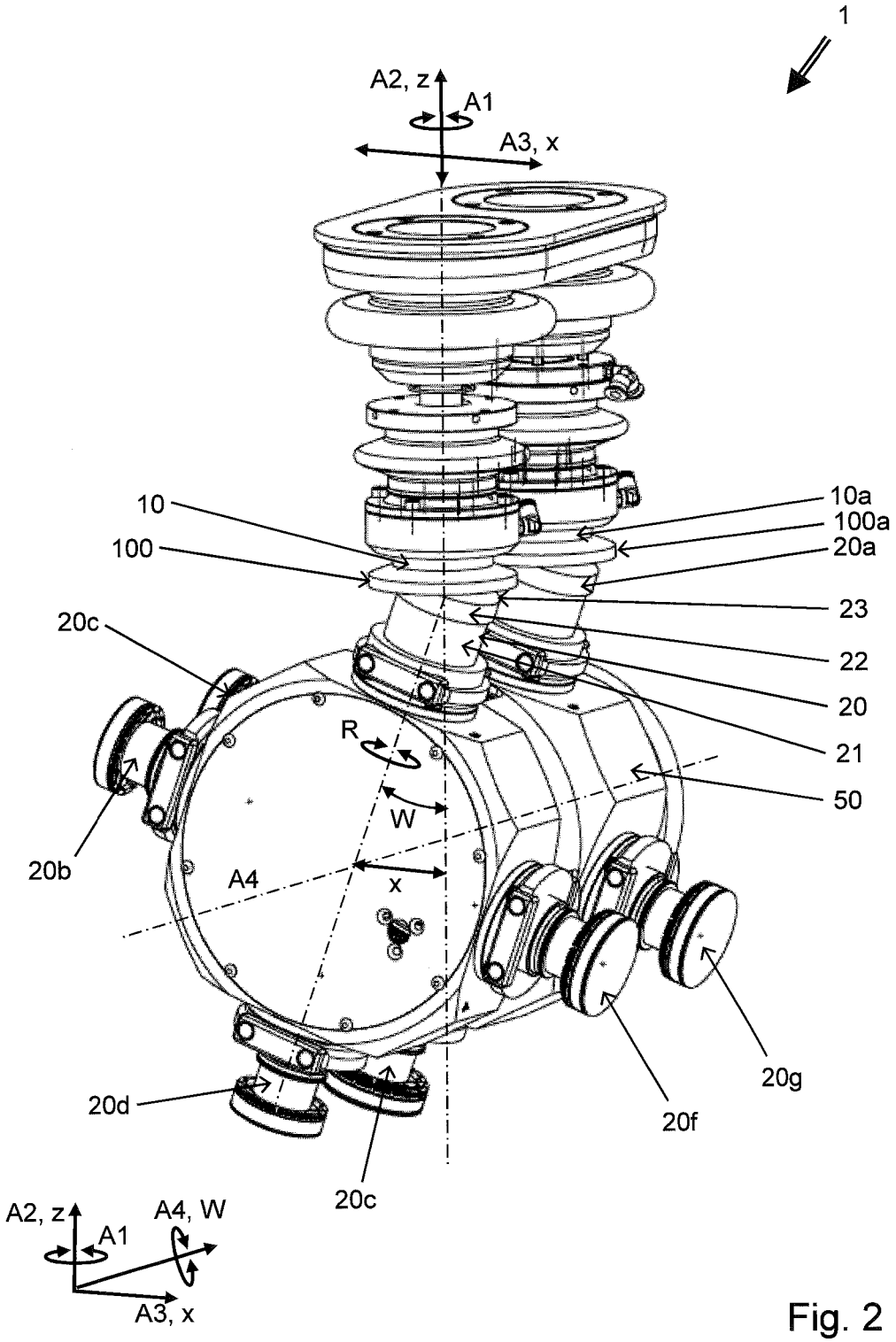
Figure 3:
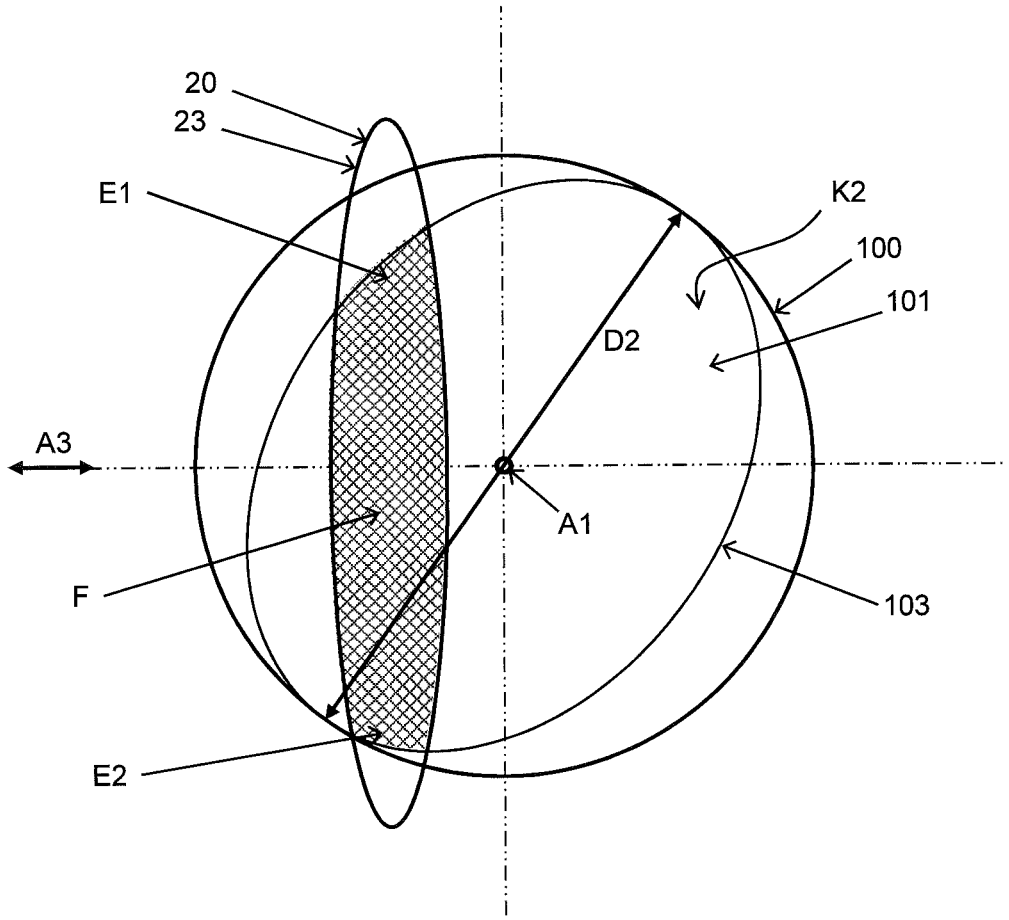
Figure 4:
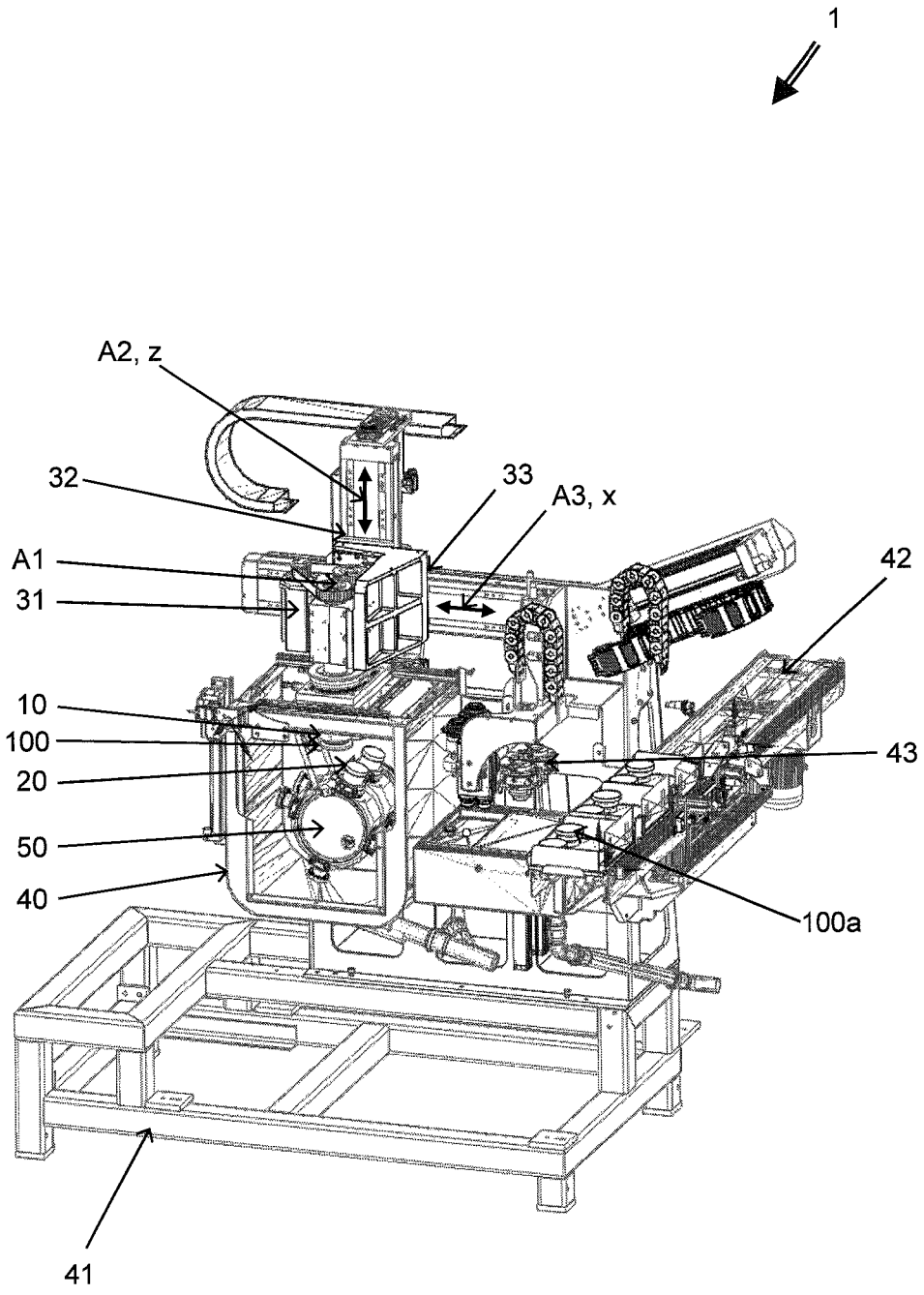

Further features, details and advantages of the invention are disclosed by the wording of the claims and by the following description of exemplary embodiments, on the basis of the drawings. These are shown in:

FIG. 1 a section through a portion of a polishing device;

FIG. 2 a perspective view of a polishing device having two working planes;

FIG. 3 a schematic diagram to illustrate the contact area of a polishing tool placed with a pitch angle on the lens face, and FIG. 4 a perspective view of a polishing device according to FIG. 2, but represented with a frame, housing and secondary equipment for automated operation.

FIG. 1 shows, in a section through a portion of a polishing device 1, how the polishing of a concave lens face 101 of an optical lens 100 is effected by means of a polishing tool 20.

The polishing device 1 is composed of two corresponding units. The first unit in this case comprises the receiver and motion kinematics of the optical lens 100, with a workpiece holder 10. The second unit relates to the polishing tool 20 and its motion kinematics.

The polishing tool 20 has a support element 21 and an elastic substructure 22 between a convex polishing surface 23 and the support element 21. The polishing tool 20, with the polishing surface 23, in this case is driven in a rotating manner about a rotation axis R. In particular, the polishing tool 20 is rotatably mounted on a tool holder, in this case, in particular, a tool drum 50. Also disposed here is a spindle drive 35, by means of which the polishing tool 20 is driven about the rotation axis R.

The tool drum 50, in turn, is driven so as to be rotatable about a fourth axis A4. This rotation is used to set and regulate, by means of a fourth drive A4, on the one hand, a pitch angle W of the polishing tool 20 relative to the optical lens 100 and, on the other hand, to enable the use of differing polishing tools, which are disposed on the circumference of the tool drum 50.

In this case, the rotation axis R and the fourth axis A4 intersect perpendicularly. This renders the motion kinematics particularly simple. However, this intersection is not absolutely necessary. Also conceivable, alternatively, are a non-perpendicular alignment and/or a spaced-apart arrangement.

In summary, the polishing tool 20 thus rotates about the rotation axis R, and can be aligned and adjusted by adaptation of the pitch angle W to the lens face 101. These are the only adjustable axes and degrees of freedom of the polishing tool 20. Thus, no cardanically mounted polishing disk is provided.

The workpiece holder 10 is driven in a rotating manner about the first axis A1, in order to rotate the optical lens 100 about its center. For this purpose, the optical lens 100 may be connected, in particular by its back side 102, either by material bonding to a so-called block piece, or a vacuum holder is used, which holds the optical lens 100 on the back side of the lens 102 by means of a vacuum.

In respect of the optical lens 100, the diameter D2 of the lens face 101, the circumferential edge 103 and the surface curvature K2 of the lens face 101 are also identified.

Furthermore, the motion kinematics of the workpiece holder 10 is also represented schematically. Firstly, the workpiece holder 10 has a first drive 31, for effecting a rotation about the first axis A1. By means of a second drive 32, the workpiece holder 10 can be moved back and forth along a second axis A2. In this case, the second axis A2 is coaxial with the first axis A1. A simple motion kinematics is thereby achieved. Additionally provided is a third drive 33, by means of which the workpiece holder 10 can be moved back and forth laterally; this, in particular, transversely, and in particular perpendicularly, in relation to the second axis A2. These are the only three axes of motion of the workpiece holder 10. Moreover, the first axis A1 is aligned perpendicularly through the center of the concave lens face 101.

It is preferred that the fourth axis A4 intersects perpendicularly the plane spanned by the second and third axis A2, A3. Moreover, preferably, the rotation axis R and the first axis A1 also intersect each other.

Thus, in this case, the first axis A1, the second axis A2 and the third axis A3 are mechanically coupled to the workpiece holder 10, i.e. these three axes determine the degrees of freedom of the workpiece holder 10. The fourth axis A4 and the rotation axis R are mechanically coupled to the polishing tool 20, i.e. they determine the degrees of freedom of the polishing tool 20.

The first axis A1 and the rotation axis R are to be disposed, as described, in order to effect the rotations of the lens 100 and of the polishing tool 20. On the other hand, alternatively, it is possible in principle for the second axis A2 and the third axis A3 to be mechanically coupled to the polishing tool 20, and/or for the fourth axis A4 to be mechanically coupled to the workpiece holder 10.

As a result of these or the stated alternative arrangements and degrees of freedom of the workpiece holder 10 and of the polishing tool 20, it is now possible to adjust and regulate a distance z between the workpiece holder 10 and the polishing tool 20, along the second axis A2. At the same time, an offset x between the workpiece holder 10 and the polishing tool 20, along the third axis A3, which is aligned transversely in relation to the first axis A1, can be adjusted and regulated. In addition, the pitch angle W between the rotation axis R and the first axis A1 can be actively adjusted and regulated, by means of the fourth drive 34, by tilting about the fourth axis A4.

It is thereby possible for the polishing tool 20 to be placed obliquely on the concave lens face 101, in such a manner that only a portion of the polishing surface 23 comes into contact with the concave lens face 101. This contact area F is represented by an overlap between the polishing tool 20 and the optical lens 100. In reality, the elastic substructure 22 deforms. Another portion of the polishing surface 23 is raised from the lens face 101. It floats to a certain extent above the lens face 101. This also affects, in particular, the center in the middle M of the polishing surface 23 around the rotation axis R.

As a result of deformation of the elastic substructure 22, a strip-type contact area F, in particular, is realized between the polishing surface 23 and the concave lens face 101, as explained in greater detail in the following with reference to FIG. 3. The more strongly the polishing tool 20 is pressed against the lens face 101, the greater the contact pressure force becomes, and the wider the contact area F becomes. Both correlate with the removal rate. Moreover, the removal rate is also determined by the rotational speed of the polishing tool 20 about the rotation axis R and by the rotational speed of the optical lens 100 about the first axis A1.

By an electric controller it is now possible, during a polishing process, in particular exclusively, for

- the speed of rotation of the workpiece holder 10 about the first axis A1,
- the distance z between the workpiece holder 10 and the polishing tool 20 along the second axis A2,
- the offset x between the workpiece holder 10 and the polishing tool 20 along the third axis A3, and
- the pitch angle W between the rotation axis R and the first axis A1, by tilting about the fourth axis A4 to be driven in an interpolating manner. This, in particular, in that

- the rotating drive of the workpiece holder 10 about the first axis A1 by means of the first drive 31 is regulated by the control means, the adjustment of the distance z between the workpiece holder 10 and the polishing tool 20 along the second axis A2 by means of the second drive 32 is regulated by the electric controller, the adjustment of the offset x between the workpiece holder 10 and the polishing tool 20 along the third axis A3 by means of the third drive 33 is regulated by the electric controller, and the adjustment of the pitch angle W between the rotation axis R and the first axis A1 by means of the fourth drive 34 is regulated by the electric controller.

During a polishing process, in particular exclusively, the rotational speed of the first drive 31, the position of the second drive 32, the position of the third drive 33, and the position of the fourth drive 34 are driven in an interpolating manner by the electric controller. Possible, in particular, is an interpolation that performs an interpolating motion of the second, third and fourth axis A2, A3, A4 over each revolution of the lens blank 100 about the first axis A1.

On the other hand, the rotational speed of the convex polishing surface 23 about the rotation axis R is preferably held to a constant rotational speed by the spindle drive 35. This rotational speed is preferably to be selected, in any case, so as to be of such a speed that, owing to the rotational inertia, a rapid modulation of the rotational speed is not possible. A rotational speed of between 600 and 1500 revolutions per minute is to be preferred.

In addition, the rotational speed at which the polishing tool 20 rotates about the rotation axis R between starting-up and decelerating should be greater than the maximum rotational speed of the rotation of the workpiece holder 10 about the first axis A1. In particular, during the polishing operation, values of between 0 and 100 revolutions per minute are appropriate as a maximum rotational speed of the rotation of the workpiece holder 10 about the first axis A1.

The pitch angle W is regulated by the electric controller, insofar as possible, to a value at which there is a maximally uniform contact pressure force present over the length of the strip-type contact area F between the polishing surface 23 and the concave lens face 101. The greater the local surface curvature K2 of the lens face 101, therefore, the greater the pitch angle W will be.

For the purpose of operating a polishing device 1, the following steps, in particular, are performed:

a) receiving an optical lens 100 by means of the workpiece holder 10, b) placing the polishing tool 20, with the polishing surface 23, on the concave lens face 101, c) rotating the polishing tool 20 about the rotation axis R, d) performing a polishing operation by driving in an interpolating manner the speed of rotation of the workpiece holder 10 about the first axis A1, the distance z between the workpiece holder 10 and the polishing tool 20 along the second axis A2, the offset x between the workpiece holder 10 and the polishing tool 20 along the third axis A3, and the pitch angle W between the rotation axis R and the first axis A1, by tilting about the fourth axis A4.

This means that, during the polishing operation, precisely four axes interpolate with one another, namely, the first, second, third and fourth axis A1, A2, A3, A4. The rotational speed about the rotation axis R it taken into account (if at all) as a constant input variable.

According to the method, it is possible for the driving in an interpolating manner to take into account, as a first objective function, a pitch angle W at which a maximally uniform contact pressure force is present over the length of a strip-type contact area F between the polishing surface 23 and the concave lens face 101. In addition, regulation can be effected such that the driving in an interpolating manner generates, as a third objective function, a contact pressure force that is maximally uniform over one rotation of the optical lens 100.

Moreover, the driving in an interpolating manner may pursue, as a second objective function, a strip-type contact area F between the polishing surface 23 and the concave lens face 101 that extends at both ends E1, E2 as far as a circumferential edge 103 of the concave lens face 101. A lens edge that surrounds the concave lens face 101 and that does not require polishing is insignificant.

As described above, the removal rate also depends on the rotational speeds, in particular on the velocity vectors in the contact area F. The velocity vectors can be determined, besides the local contact pressure force, solely on the basis of the positions of the workpiece holder 10, the polishing tool 20 and the surface shape of the lens face 101. This enables the driving in an interpolating manner to take into account, as a fourth objective function, a maximally constant removal profile in the contact area F between the polishing surface 23 and the concave lens face 101.

FIG. 2 shows a perspective view of a polishing device 1 having two working planes. Located in the working plane that is foremost in the direction of the image are a workpiece holder 10 and a polishing tool 20 according to the section shown in FIG. 1. For reasons of clarity, only some of the technical features are denoted by references here.

In particular, it can be seen that the workpiece holder 10 holds an optical lens 100 that is machined by means of the polishing tool 20. The polishing tool 20 is composed of a support element 21, an elastic substructure 22 mounted thereon, and a polishing surface 23 on the elastic substructure 22.

As also in FIG. 1, the workpiece holder 10 can be displaced along the second axis A2, to enable regulation of a distance z between the workpiece holder 10 and the polishing tool 20. An offset x between the workpiece holder 10 and the polishing tool 20 can also be regulated, by displacing the workpiece holder 10 along the third axis A3. At the same time, the workpiece holder 10, including an optical lens 100, is rotated about a first axis A1.

On the other side, the polishing tool 20 is driven in a rotating manner about a rotation axis R. In addition, the tool drum 50, on which the polishing tool 20 is mounted so as to be rotatable about the rotation axis R, can be rotated about a fourth axis A4, in order to regulate the pitch angle W of the polishing tool 20 on the lens 100.

In respect of the further details relating to the workpiece holder 10 and the polishing tool 20, reference is made to the description above relating to FIG. 1.

It can furthermore be seen from FIG. 2 that there is also an optional, second working plane. The latter is realized such that it is functionally identical to the front working plane. Two lenses 100, 100*a* can thus be machined simultaneously and in an identical manner. In particular, the working planes are fixedly connected to one another in respect of the degrees of freedom of the workpiece holder 10, 10*a* and of the polishing tool 20, 20*a*. The working planes also share the drives, such that the workpiece holders 10, 10*a* and the polishing tools 20, 20*a* move synchronously.

A further optional detail of the embodiment according to FIG. 2 is that the tool drum 50, in each of the working planes, has a plurality of polishing tools, in particular in this case four, in particular, differing polishing tools 20, 20*a*, 20*b*, 20*c*, 20*d*, 20*e*, 20*f*, 20*g*. The third to eighth polishing tools 20*b*, 20*c*, 20*d*, 20*e*, 20*f*, 20*g* may also be polishing disks that have a cardanic compensating joint. These polishing disks then bear against the lens faces of the lenses 100, 100*a* and oscillate about the cardanic compensating joint.

FIG. 3 shows a schematic diagram to illustrate the contact area F of a polishing tool 20 placed with a pitch angle on a lens face 101 of an optical lens 100.

Of the lens face 101, the circumferential edge 103, the surface curvature K2 and the diameter D2 are also identified. An optical transition line shows that the already pre-machined lens 100 has a toric lens face 101. This means that the lens face 101 to be polished is oval, or elliptical. Two crescent-shaped edge regions do not need to be polished concomitantly.

Cross-hatching then indicates, in particular, the contact area F between the polishing surface 23 and the lens face 101. This contact area is in the form of a strip, and extends at both ends E1, E2 as far as a circumferential edge 103 of the concave lens face 101. With other regions, the polishing surface 23 projects beyond the circumferential edge 103 at the ends E1, E2. The figure does not show the parts of the polishing surface 23 that float above the lens face 101, as shown in FIG. 1.

Additionally identified are the movements of the lens 100 about the first axis A1 and along the axis A3.

FIG. 4 shows a perspective view of a polishing device 1 according to FIG. 2, but represented with a frame 41, housing 40 and secondary means for automated operation.

The frame 41 supports both the polishing tool 20 and the workpiece holder 10. The entire tool drum 50, together with the polishing tool 20 and the workpiece holder, are disposed inside the housing 40. On the front side, the housing 40 has an inspection window and a flap, or door. The drives 31, 32, 33, 34 are clearly visible in the representation of FIG. 4. The first drive 31 drives the workpiece holder 10 in a rotating manner about the first axis A1.

The second and the third drive 32, 33 are realized as cross slides, such that the displacements for regulating the offset x and the distance z can be regulated.

Also shown is a transport rail 42, via which lenses 100*a* that have been pre-machined in an automated manner are provided and removed again after machining.

A loading means 43 is used to remove the lenses 100, 100*a* from the transport rail 42, before the polishing operation, and load them into the workpiece holder 10. After polishing, they are taken back out of the workpiece holder 10 by means of the loading means 43 and deposited on the transport rail 42 for removal.

The invention is not limited to one of the embodiments described above, but may be modified in various ways.

In particular, the above descriptions also apply to an optional modification, in which the curved lens face 101 is convex and the curved polishing surface 23 is concave. In particular, in the tool drum 50, polishing tools 20*b*, 20*c* having a concave polishing surface 23 may also be used in addition to the polishing tools 20, 20*a*. Concave and convex lens faces 101 can then be machined in the same polishing device 1.

All features and advantages arising from the claims, the description and the drawing, including structural design details, spatial arrangements and method steps, may be essential for the invention, both separately and in the most diverse combinations.

| List of references | |
|---|---|
| 1 | polishing device |
| 10 | workpiece holder |
| 10a | second workpiece holder |
| 20 | polishing tool |
| 20a | second polishing tool |
| 20b | third polishing tool |
| 20c | fourth polishing tool |
| 20d | fifth polishing tool |
| 20e | sixth polishing tool |
| 20f | seventh polishing tool |
| 20g | eighth polishing tool |
| 21 | support element |
| 22 | elastic substructure |
| 23 | convex polishing surface |
| 31 | first drive (first axis) |
| 32 | second drive (second axis) |
| 33 | third drive (third axis) |
| 34 | fourth drive (fourth axis) |
| 35 | spindle drive |
| 40 | housing |
| 41 | frame |
| 42 | transport rail |
| 43 | loading means |
| 50 | tool drum |
| 100 | optical lens |
| 100a | second optical lens |
| 101 | lens face |
| 102 | back side of lens |
| 103 | circumferential edge |
| A1 | first axis (rotation) |
| A2 | second axis (distance) |
| A3 | third axis (offset) |
| A4 | fourth axis (pitch angle) |
| D1 | diameter (polishing surface) |
| D2 | diameter (lens face) |
| E1 | first end (strip-type contact area) |
| E2 | second end (strip-type contact area) |
| F | strip-type contact area |
| K1 | surface curvature (polishing surface) |
| K2 | surface curvature (lens face) |
| M | center (polishing surface) |
| R | rotation axis |
| W | pitch angle |
| z | distance |
| x | offset |

The invention claimed is:

1. A polishing device (1) for polishing curved lens faces (101) of optical lenses (100), the polishing device (1) having a workpiece holder (10) for receiving an optical lens (100) and having a polishing tool (20), the polishing tool (20) having a support element (21) with a curved polishing surface (23), being driven in a rotating manner about a rotation axis (R), either the curved lens face (101) being concave and the curved polishing surface (23) being convex, or the curved lens face (101) being convex and the curved polishing surface (23) being concave, the workpiece holder (10) being driven in a rotating manner about a first axis (A1), in order to rotate the optical lens (100), a distance (z) between the workpiece holder (10) and the polishing tool (20) being adjustable along a second axis (A2), an offset (x) between the workpiece holder (10) and the polishing device (20) being adjustable along a third axis (A3), which is aligned transversely in relation to the first axis (A1), wherein the curved polishing surface (23) is located on an elastic substructure (22) of the polishing tool (20), a pitch angle (W) between the rotation axis (R) and the first axis (A1) is adjustable by tilting about a fourth axis (A4), when there is an optical lens (100) received in the workpiece holder (10), the polishing tool (20) can be placed, according to the pitch angle (W), obliquely on the curved lens face (101), and a strip-type contact area (F) can be realized between the polishing surface (23) and the curved lens face (101) as a result of deformation of the elastic substructure (22), and the pitch angle (W) between the rotation axis (R) and the first axis (A1) being such a magnitude that the polishing surface (23) is partially raised from the curved lens face (101) and a portion of the polishing surface (23) floats above the lens face (101) at a lateral distance from the contact area.

2. The polishing device (1) as claimed in claim 1, wherein the strip-type contact area (F) extends at both ends (E1, E2) as far as a circumferential edge (103) of the curved lens face (101).

3. The polishing device (1) as claimed in claim 1, further comprising an electric controller, wherein during a polishing process, the speed of rotation of the workpiece holder (10) about the first axis (A1), the distance (z) between the workpiece holder (10) and the polishing tool (20) along the second axis (A2), the offset (x) between the workpiece holder (10) and the polishing tool (20) along the third axis (A3), and the pitch angle (W) between the rotation axis (R) and the first axis (A1), by tilting about the fourth axis (A4), are driven by the electric controller in an interpolating manner.

4. The polishing device (1) as claimed in claim 3, wherein the pitch angle (W) is regulated, by the electric controller, to a value at which a maximally uniform contact pressure force is present over the length of a strip-type contact area (F) between the polishing surface (23) and the curved lens face (101).

5. The polishing device (1) as claimed in claim 1, wherein the second axis (A2) and the third axis (A3) are mechanically coupled to the workpiece holder (10).

6. The polishing device (1) as claimed in claim 1, wherein the fourth axis (A4) is mechanically coupled to the polishing tool (20).

7. A method for operating a polishing device (1) comprising:

a workpiece holder (10) for receiving an optical lens (100) and having a polishing tool (20), the polishing tool (20) having a support element (21) with a curved polishing surface (23), being driven in a rotating manner about a rotation axis (R), either the curved lens face (101) being concave and the curved polishing surface (23) being convex, or the curved lens face (101) being convex and the curved polishing surface (23) being concave, the workpiece holder (10) being driven in a rotating manner about a first axis (A1), in order to rotate the optical lens (100), a distance (z) between the workpiece holder (10) and the polishing tool (20) being adjustable along a second axis (A2), an offset (x) between the workpiece holder (10) and the polishing device (20) being adjustable along a third axis (A3), which is aligned transversely in relation to the first axis (A1), wherein the curved polishing surface (23) is located on an elastic substructure (22) of the polishing tool (20), a pitch angle (W) between the rotation axis (R) and the first axis (A1) is adjustable by tilting about a fourth axis (A4), when there is an optical lens (100) received in the workpiece holder (10), the polishing tool (20) can be placed, according to the pitch angle (W), obliquely on the curved lens face (101), and a strip-type contact area (F) can be realized between the polishing surface (23) and the curved lens face (101) as a result of deformation of the elastic substructure (22), and the pitch angle (W) between the rotation axis (R) and the first axis (A1) being such a magnitude that the polishing surface (23) is partially raised from the curved lens face (101) and a portion of the polishing surface (23) floats above the lens face (101) at a lateral distance from the contact area, the method comprising the following steps:

a) receiving an optical lens (100) with the workpiece holder (10), b) placing the polishing tool (20), with the polishing surface (23), on the curved lens face (101), c) rotating the polishing tool (20) about the rotation axis (R), d) performing a polishing operation, by driving in an interpolating manner the speed of rotation of the workpiece holder (10) about the first axis (A1), the distance (z) between the workpiece holder (10) and the polishing tool (20) along the second axis (A2), the offset (x) between the workpiece holder (10) and the polishing tool (20) along the third axis (A3), and the pitch angle (W) between the rotation axis (R) and the first axis (A1), by tilting about the fourth axis (A4), wherein the polishing tool (20) is placed, according to the pitch angle (W), obliquely on the curved lens face (101), and a strip-type contact area (F) is realized between the polishing surface (23) and the curved lens face (101) as a result of deformation of the elastic substrate (22), and the pitch angle (2) between the rotation axis (R) and the first axis (A1) being of such a magnitude that the polishing surface (23) is partially raised from the curved lens face (101) and a portion of the polishing surface (23) floats above the lens face (101) at a lateral distance from the contact area.

8. The method as claimed in claim 7, wherein the driving in the interpolating manner takes into account, as a first objective function, the pitch angle (W) at which a maximally uniform contact pressure force is present over the length of the strip-type contact area (F) between the polishing surface (23) and the curved lens face (101).

9. The method as claimed in claim 8, wherein the driving in the interpolating manner takes into account, as a second objective function, the strip-type contact area (F) between the polishing surface (23) and the curved lens face (101) that extends at both ends (E1, E2) as far as a circumferential edge (103) of the curved lens face (101).

10. The method as claimed in claim 7, wherein the driving in the interpolating manner takes into account, as a third objective function, a contact pressure force that is maximally uniform over a revolution of the optical lens (100).

11. The method as claimed in claim 7, wherein the driving in the interpolating manner takes into account, as a fourth objective function, a constant removal profile in the strip-type contact area (F) between the polishing surface (23) and the curved lens face (101).

12. The method as claimed in claim 7, wherein, for each revolution of the optical lens (100) about the first axis (A1), the pitch angle (W) between the rotation axis (R) and the first axis (A1) is tilted to and fro twice about the fourth axis (A4).

13. The method as claimed in claim 7, wherein, for each revolution of the optical lens (100) about the first axis (A1), the offset (x) between the workpiece holder (10) and the polishing tool (20) along the third axis (A3) oscillates to and fro twice.

14. The method as claimed in claim 7, wherein the rotating of the polishing tool (20) about the rotation axis (R) is effected at a constant rotational speed, between starting-up and decelerating.

* * * * *